US008911046B2

(12) United States Patent
Menzel

(10) Patent No.: US 8,911,046 B2
(45) Date of Patent: Dec. 16, 2014

(54) METHOD, APPARATUS, AND SYSTEM TO PROVIDE DROPLETS WITH CONSISTENT ARRIVAL TIME ON A SUBSTRATE

(71) Applicant: Christoph Menzel, New London, NH (US)

(72) Inventor: Christoph Menzel, New London, NH (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 12 days.

(21) Appl. No.: 13/841,544

(22) Filed: Mar. 15, 2013

(65) Prior Publication Data

US 2014/0267481 A1 Sep. 18, 2014

(51) Int. Cl.
*B41J 29/38* (2006.01)
*B41J 2/045* (2006.01)

(52) U.S. Cl.
CPC ..... *B41J 2/04588* (2013.01); *B41J 2/04596* (2013.01)
USPC ..... 347/11; 347/9; 347/10

(58) Field of Classification Search
CPC ..... B41J 2/04588; B41J 2/04591; B41J 2/04593; B41J 2/04595; B51J 2/04596
USPC ..... 347/9, 10, 11, 15, 17
See application file for complete search history.

(56) References Cited

U.S. PATENT DOCUMENTS 6,328,395 B1 12/2001 Kitahara et al.
6,663,212 B2 * 12/2003 Kojima ..... 347/17
2006/0181557 A1 8/2006 Hoisington et al.
2009/0289982 A1 11/2009 Hasenbein

FOREIGN PATENT DOCUMENTS

EP 1735165 11/2012

OTHER PUBLICATIONS

International Search Report and the Written Opinion of the International Searching Authority for PCT/US2014/019077 mailed Jun. 24, 2014, 10 pages.

* cited by examiner

*Primary Examiner* — Juanita D Jackson
(74) *Attorney, Agent, or Firm* — Blakely, Sokoloff, Taylor & Zafman LLP

(57) ABSTRACT

Described herein is a method, apparatus, and system for driving a droplet ejection device with multi-pulse waveforms. In one embodiment, a method for driving a droplet ejection device having an actuator includes applying a first subset of a multi-pulse waveform to the actuator to cause the droplet ejection device to eject a first droplet of a fluid in response to the first subset. The method includes applying a second subset of the multi-pulse waveform to the actuator to cause the droplet ejection device to eject a second droplet of the fluid in response to the second subset. The first subset includes a drive pulse that is positioned in time near a beginning of a clock cycle of the first subset. The first droplet has a smaller volume than the second droplet.

18 Claims, 17 Drawing Sheets

METHOD, APPARATUS, AND SYSTEM TO PROVIDE DROPLETS WITH CONSISTENT ARRIVAL TIME ON A SUBSTRATE

TECHNICAL FIELD

Embodiments of the present invention relate to droplet ejection, and more specifically to using multi-pulse waveforms for variable drop size ejection and consistent arrival time on a target substrate.

BACKGROUND

Droplet ejection devices are used for a variety of purposes, most commonly for printing images on various media. They are often referred to as ink jets or ink jet printers. Drop-on-demand droplet ejection devices are used in many applications because of their flexibility and economy. Drop-on-demand devices eject one or more droplets in response to a specific signal, usually an electrical waveform that may include a single pulse or multiple pulses. Different portions of a multi-pulse waveform can be selectively activated to produce the droplets.

Droplet ejection devices typically include a fluid path from a fluid supply to a nozzle path. The nozzle path terminates in a nozzle opening from which droplets are ejected. Each ink jet has a natural frequency which is related to the inverse of the period of a sound wave propagating through the length of the ejector (or jet). The jet natural frequency can affect many aspects of jet performance. For example, the jet natural frequency typically affects the frequency response of the printhead. Typically, the jet velocity remains near a target velocity for a range of frequencies from substantially less than the natural frequency up to about 25% of the natural frequency of the jet. As the frequency increases beyond this range, the jet velocity begins to vary by increasing amounts. This variation is caused, in part, by residual pressures and flows from the previous drive pulse(s). These pressures and flows interact with the current drive pulse and can cause either constructive or destructive interference, which leads to the droplet firing either faster or slower than it would otherwise fire.

One prior ink jetting approach uses a pulse string followed by a cancelling pulse. The cancelling pulse is a shortened pulse that is timed so that the resulting pressure pulses arrive at the nozzle out of phase with the residual pressure from previous pulses. Given that jets will have a dominant resonant frequency, the cancellation features are timed in units of resonance period Tc. FIGS. 1*a* and 1*b* show two common types of cancellation pulses: same sense cancellation pulse 180 in FIG. 1*a* and opposite sense cancellation pulse 199 in FIG. 1*b*. A same sense cancellation pulse is preceded by a cancel edge delay, which has a voltage level that is similar to a voltage level of one or more delays between drive pulses. An opposite sense cancellation pulse is preceded by a cancel edge delay, which has a voltage level that is different than a voltage level of one or more delays between drive pulses. The voltage level of the cancel edge delay is in the opposite direction, relative to the bias level or level between fire pulses, compared to the fire pulse. FIG. 1*a* illustrates a fire edge of pulse 181 that is followed by a cancellation puke delay 182 (e.g., To) and then cancellation pulse 180. FIG. 1*b* illustrates pulses 190-197, a fire edge 198 that is followed by a cancellation pulse delay 184 (e.g., Tc) and then cancellation pulse 199. In these architectures, a large droplet is created by expressing all the pulses while smaller droplets are expressed by removing the earlier pulse(s). Hence, considering the opposite sense cancellation pulse 199 shown in FIG. 1*b*, a middle droplet may be constructed from pulses 193, 194, 195, 196, 197, and the cancellation pulse 199 while a small droplet could be formed using the pulse 197 and the cancellation pulse 199.

FIGS. 2*a* and 2*b* show prior waveform designs for a small droplet with a same sense cancellation pulse 210 and an opposite sense cancellation pulse 220. In both cancellation pulse styles, the small droplet pulse occurs at the end of the waveform directly in front of the cancellation pulse 210 or 220. These waveforms have the advantage that the cancellation pulse effectively controls the meniscus motion. These waveforms have the disadvantage that the small droplet formation is late compared to the formation of the other droplets that use pulses that start earlier. This small droplet arrives at the medium (e.g., paper) later because this droplet is formed late. Typically, the fire pulse amplitude is increased in order to compensate. However, since faster droplets tend not to form single droplets, but instead have a slower droplet formed out of the tail, there are practical limits to this strategy.

BRIEF DESCRIPTION OF THE DRAWINGS

The present invention is illustrated by way of example, and not by way of limitation, in the figures of the accompanying drawings and in which.

DETAILED DESCRIPTION

Described herein is a method, apparatus, and system for driving a droplet ejection device with multi-pulse waveforms. In one embodiment, a method for driving a droplet ejection device having an actuator includes applying a first subset of a multi-pulse waveform to the actuator to cause the droplet ejection device to eject a first droplet of a fluid in response to the first subset. The method includes applying a second subset of the multi-pulse waveform to the actuator to cause the droplet ejection device to eject a second droplet of the fluid in response to the second subset. The first subset includes a drive pulse that is positioned in time near a beginning of a clock cycle of the first subset. The first droplet has a smaller volume than the second droplet.

Multi-pulse waveforms need to perform a large number of functions together to deliver value. These functions may include providing various drop masses, maintaining the overall firing frequency, maintaining acceptable drop formation by avoiding satellite droplets, maintaining straightness of ejected droplets, ensuring droplets arrive at the target medium (e.g., paper, etc.) or substrate within a designated pixel, and controlling and stabilizing the meniscus post droplet break-off. All these functions make potentially competing demands on waveforms. The waveforms of the present design enhance meniscus control, provide consistent droplet arrival time at the target medium, and improve droplet formation.

Figure 1A:
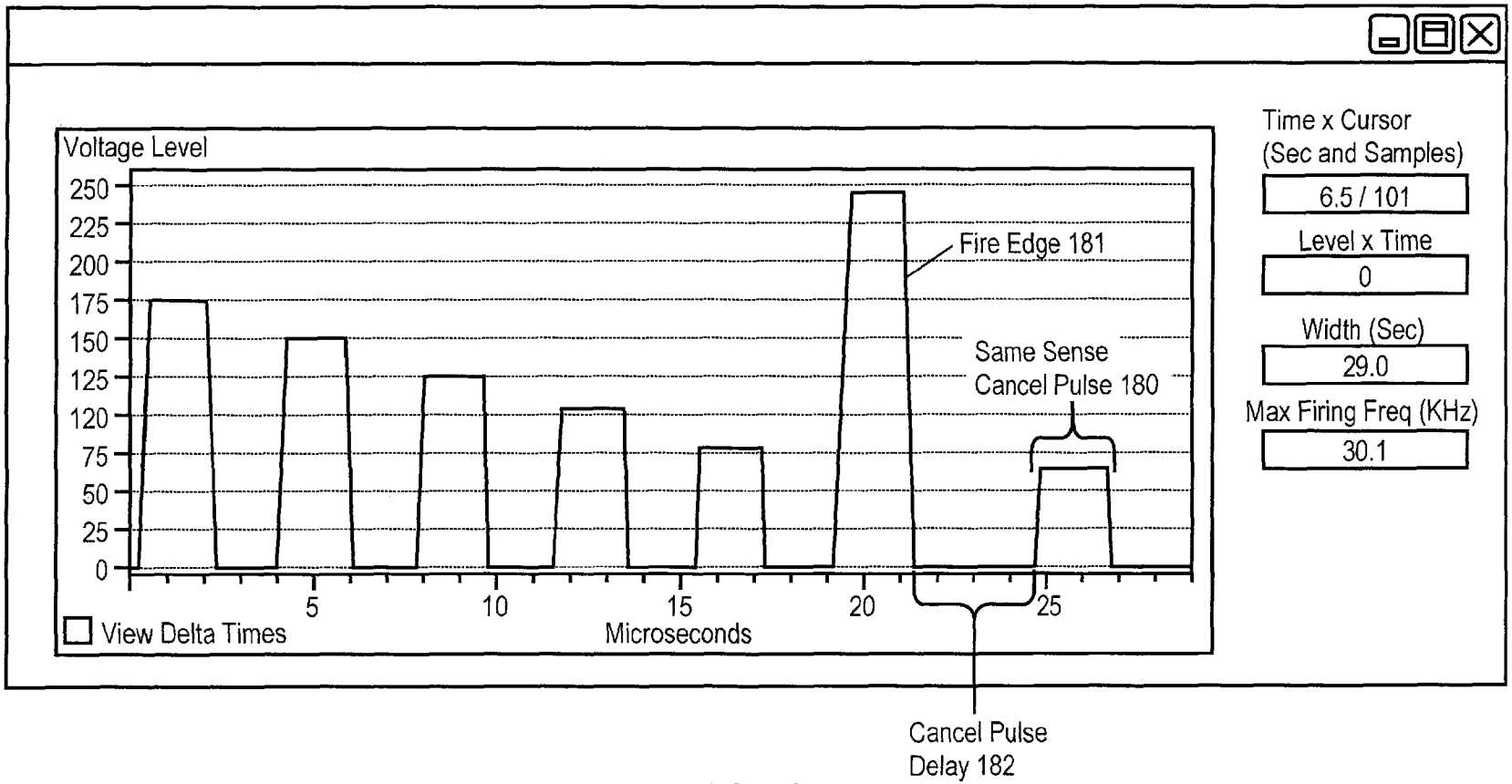
FIG. 1A PRIOR ART
FIGS. 1*a* and 1*b* illustrate waveforms of an ink jet according to a prior approach.
Figure 1B:
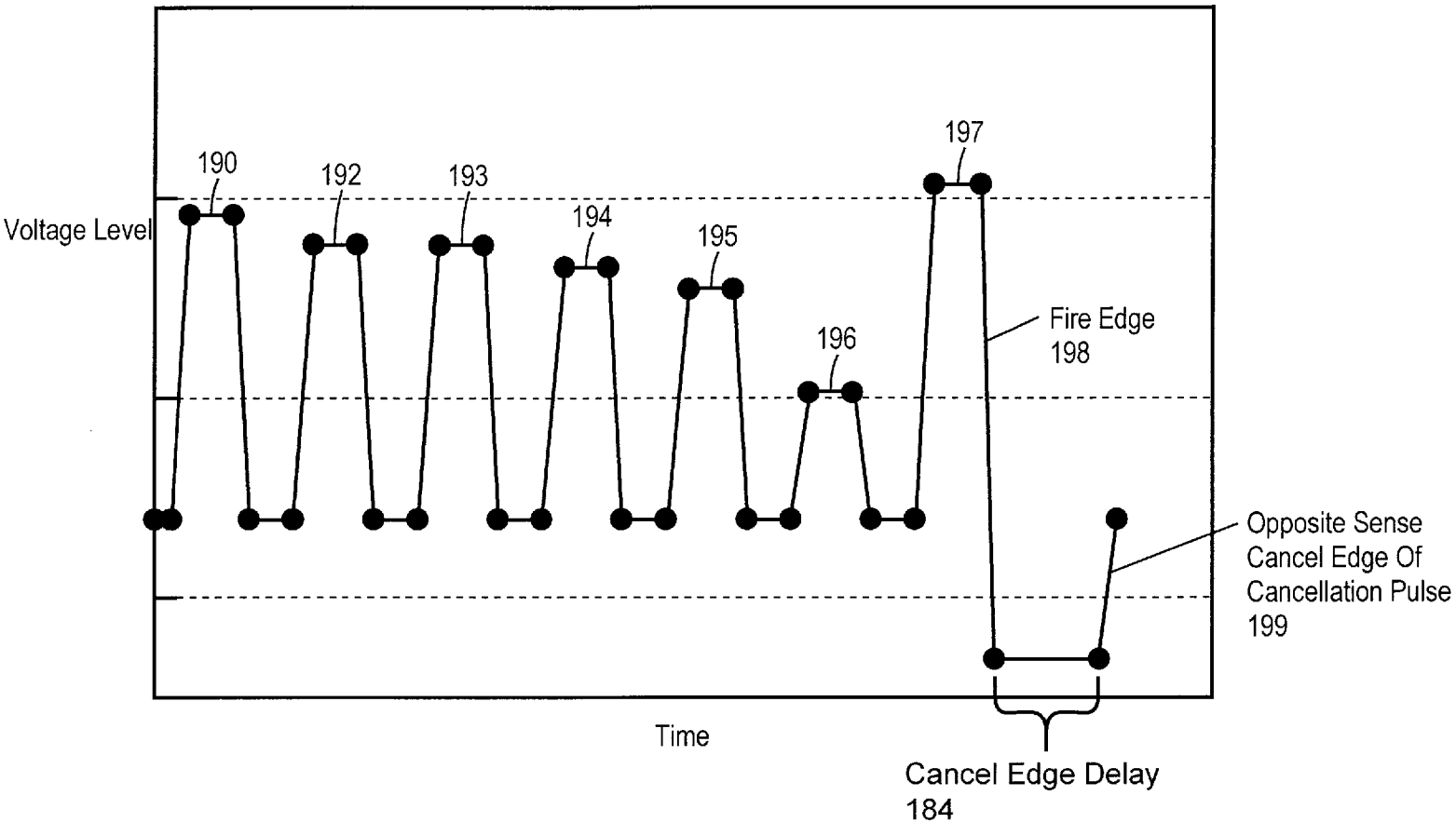
FIG. 1B PRIOR ART
Figure 2A:
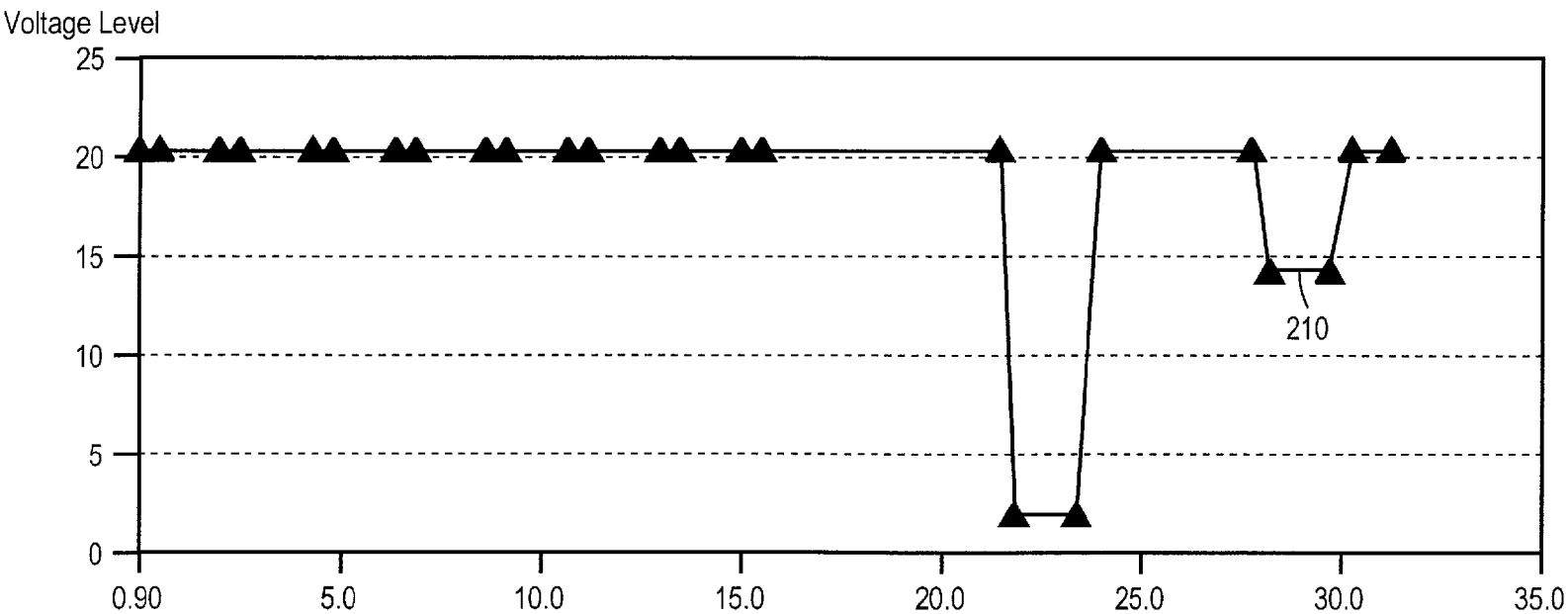
FIG. 2A PRIOR ART
FIGS. 2*a* and 2*b* illustrate waveforms of an ink jet according to another prior approach.
Figure 2B:
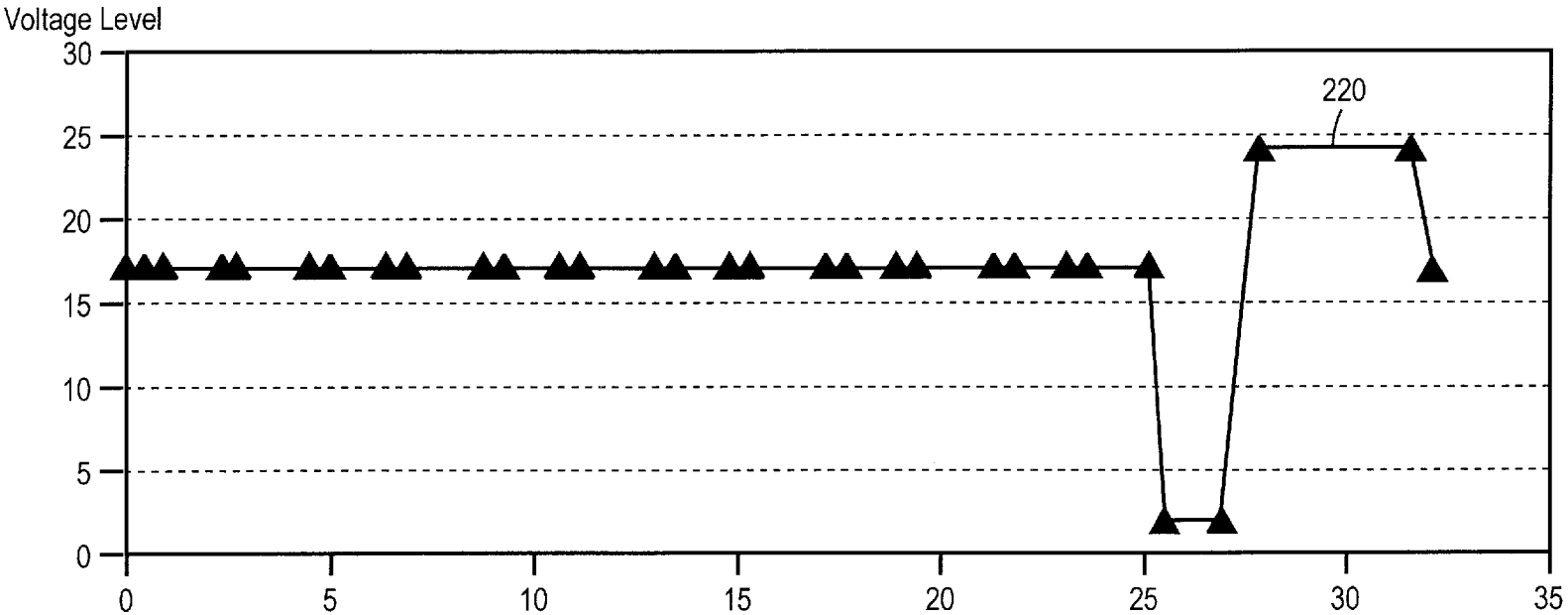
FIG. 2B PRIOR ART
Figure 3:
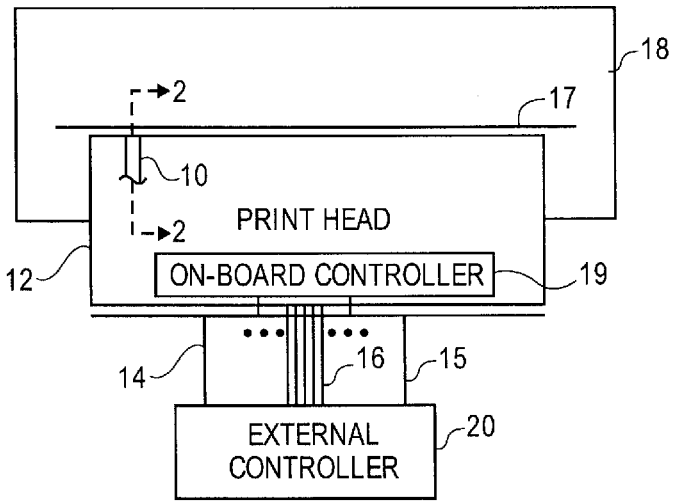
FIG. 3 is a piezoelectric ink jet print head in accordance with one embodiment.

FIG. 3 is a piezoelectric ink jet print head in accordance with one embodiment. As shown in FIG. 3, the 128 individual droplet ejection devices 10 (only one is shown on FIG. 3) of print head 12 are driven by constant voltages provided over supply lines 14 and 15 and distributed by on-board control circuitry 19 to control firing of the individual droplet ejection devices 10. External controller 20 supplies the voltages over lines 14 and 15 and provides control data and logic power and timing over additional lines 16 to on-board control circuitry 19. Ink jetted by the individual ejection devices 10 can be delivered to form print lines 17 on a substrate 18 that moves under print head 12. While the substrate 18 is shown moving past a stationary print head 12 in a single pass mode, alternatively the print head 12 could also move across the substrate 18 in a scanning mode.

Figure 4:
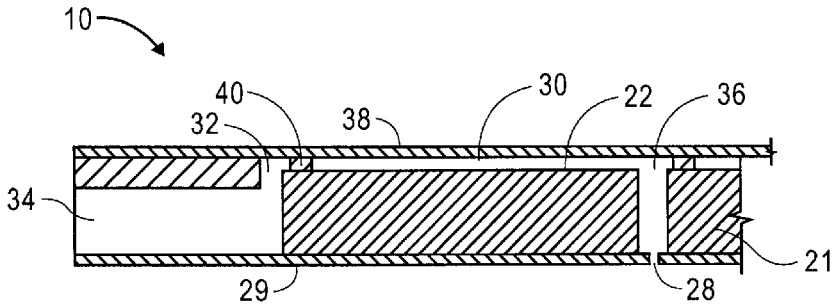
FIG. 4 is a cross-sectional side view through an ink jet module in accordance with one embodiment.

FIG. 4 is a cross-sectional side view through an ink jet module in accordance with one embodiment. Referring to FIG. 4, each droplet ejection device 10 (e.g., apparatus) includes an elongated pumping chamber 30 in the upper face of semiconductor block 21 of print head 12. Pumping chamber 30 extends from an inlet 32 (from the source of ink 34 along the side) to a nozzle flow path in descender passage 36 that descends from the upper surface 22 of block 21 to a nozzle opening 28 in lower layer 29. A flat piezoelectric actuator 38 covering each pumping chamber 30 is activated by a voltage provided from line 14 and switched on and off by control signals from on-board circuitry 19 to distort the piezoelectric actuator shape and thus the volume in chamber 30 and discharge a droplet at the desired time in synchronism with the relative movement of the substrate 18 past the print head device 12. A flow restriction 40 is provided at the inlet 32 to each pumping chamber 30.

Figure 5:
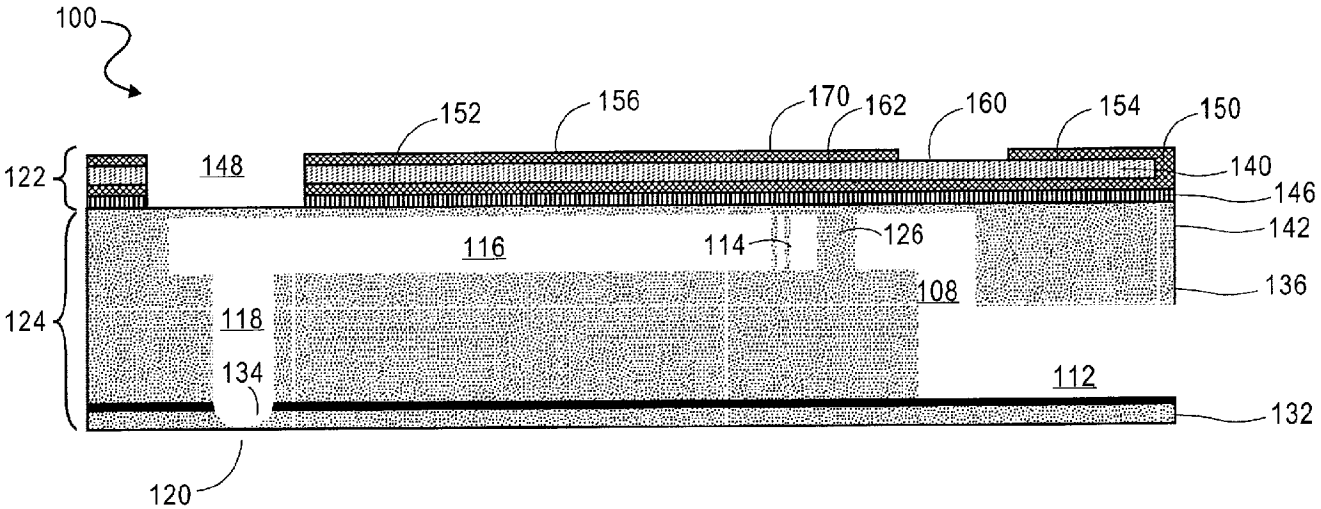
FIG. 5 illustrates a piezoelectric drop on demand printhead module for ejecting droplets of ink on a substrate to render an image in accordance with one embodiment.

FIG. 5 illustrates a piezoelectric drop on demand printhead module for ejecting droplets of ink on a substrate to render an image in accordance with one embodiment. The module has a series of closely spaced nozzle openings from which ink can be ejected. Each nozzle opening is served by a flow path including a pumping chamber where ink is pressurized by a piezoelectric actuator. Other modules may be used with the techniques described herein.

Referring to FIG. 5, which illustrates a cross-section through a flow path of a single jetting structure in a module 100, ink enters the module 100 through a supply path 112, and is directed by an ascender 108 to an impedance feature 114 and a pumping chamber 116. Ink flows around a support 126 prior to flowing through the impedance feature 114. Ink is pressurized in the pumping chamber by an actuator 122 and directed through a descender 118 to a nozzle opening 120 from which droplets are ejected.

The flow path features are defined in a module body 124. The module body 124 includes a base portion, a nozzle portion and a membrane. The base portion includes a base layer of silicon (base silicon layer 136). The base portion defines features of the supply path 112, the ascender 108, the impedance feature 114, the pumping chamber 116, and the descender 118. The nozzle portion is formed of a silicon layer 132. In one embodiment, the nozzle silicon layer 132 is fusion bonded to the silicon layer 136 of the base portion and defines tapered walls 134 that direct ink from the descender 118 to the nozzle opening 120. The membrane includes a membrane silicon layer 142 that is fusion bonded to the base silicon layer 136, opposite to the nozzle silicon layer 132.

In one embodiment, the actuator 122 includes a piezoelectric layer 140 that has a thickness of about 21 microns. The piezoelectric layer 140 can be designed with other thicknesses as well. A metal layer on the piezoelectric layer 140 forms a ground electrode 152. An upper metal layer on the piezoelectric layer 140 forms a drive electrode 156. A wrap-around connection 150 connects the ground electrode 152 to a ground contact 154 on an exposed surface of the piezoelectric layer 140. An electrode break 160 electrically isolates the ground electrode 152 from the drive electrode 156. The metallized piezoelectric layer 140 is bonded to the silicon membrane 142 by an adhesive layer 146. In one embodiment, the adhesive is polymerized benzocyclobutene (BCB) but may be various other types of adhesives as well.

The metallized piezoelectric layer 140 is sectioned to define active piezoelectric regions over the pumping chambers 116. In particular, the metallized piezoelectric layer 140 is sectioned to provide an isolation area 148. In the isolation area 148, piezoelectric material is removed from the region over the descender. This isolation area 148 separates arrays of actuators on either side of a nozzle array.

Figure 6:
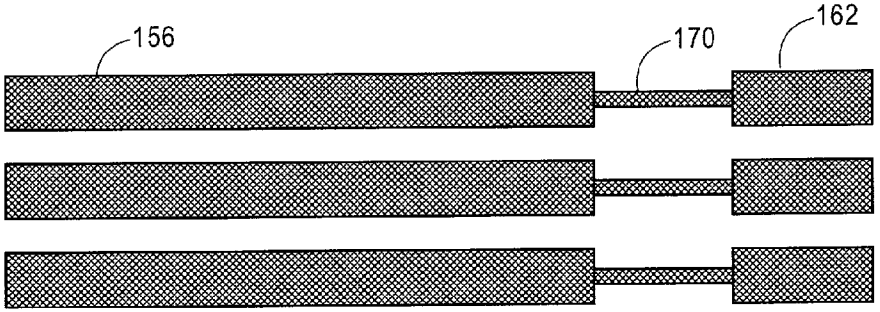
FIG. 6 illustrates a top view of a series of drive electrodes corresponding to adjacent flow paths in accordance with one embodiment.

FIG. 6 illustrates a top view of a series of drive electrodes corresponding to adjacent flow paths in accordance with one embodiment. Each flow path has a drive electrode 156 connected through a narrow electrode portion 170 to a drive electrode contact 162 to which an electrical connection is made for delivering drive pulses. The narrow electrode portion 170 is located over the impedance feature 114 and reduces the current loss across a portion of the actuator 122 that need not be actuated. Multiple jetting structures can be formed in a single printhead die. In one embodiment, during manufacture, multiple dies are formed contemporaneously.

A PZT member or element (e.g., actuator) is configured to vary the pressure of fluid in the pumping chambers in response to the drive pulses applied from the drive electronics. For one embodiment, the actuator ejects droplets of a fluid from a nozzle via the pumping chambers. The drive electronics are coupled to the PZT member. During operation of the printhead module, the actuators eject a droplet of a fluid from a nozzle. In one embodiment, the drive electronics are coupled to the actuator with the drive electronics driving the actuator with a first subset of a multi-pulse waveform having predetermined positions in time and a second subset of the multi-pulse waveform to cause the actuator to eject a first droplet of a fluid in response to the first subset and to eject a second droplet of the fluid in response to the second subset. The first subset includes a drive pulse that is positioned in time near a beginning of a clock cycle of the first subset (e.g., drive pulse in a first or second predetermined position of the clock cycle). The first droplet has a smaller volume than the second droplet. The first droplet arrives on a first pixel and the second droplet arrives on a second pixel that is adjacent to the first pixel of a substrate because of the positioning of the drive pulse towards the beginning of the clock cycle of the first subset.

The drive pulse of the first subset may be followed by a cancellation pulse or cancel edge that reduces pressure response wave(s) associated with the drive pulse. The second subset of the multi-pulse waveform may have at least two drive pulses and at least two cancel edges. The cancel edges of the second subset may build a mass of fluid for a subsequent drive pulse. A first cancel edge may be applied subsequent to a first drive pulse of the second subset of the multi-pulse waveform. A second or third cancel edge is applied subsequent to a second drive pulse of the second subset of the multi-pulse waveform. The second subset of the multi-pulse waveform may include four drive pulses and three cancel edges. The drive electronics can apply a third subset of the multi-pulse waveform having at least two drive pulses and at least two cancel edges to the actuator to cause the actuator to eject a third droplet of the fluid. The third droplet may have a volume that is less than the volume of the first droplet.

Figure 7:
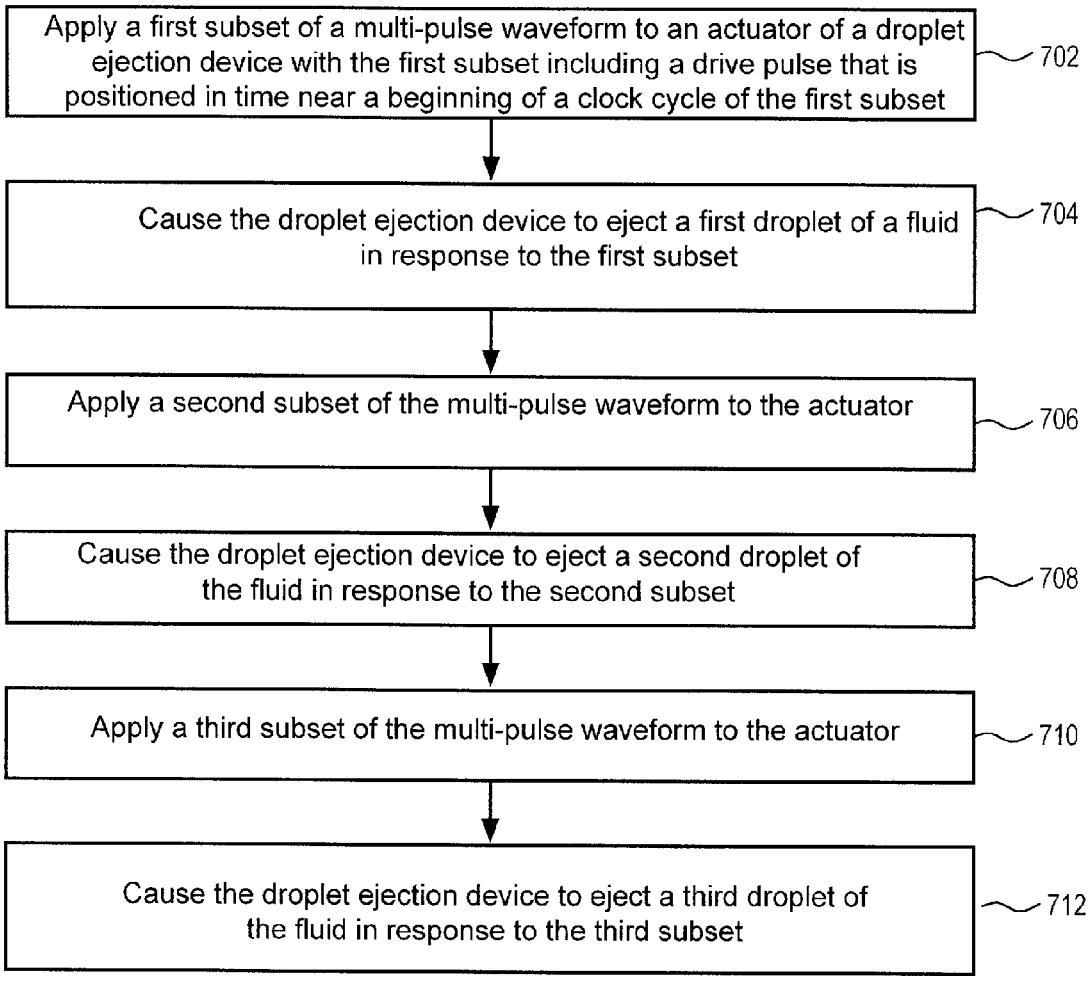
FIG. 7 illustrates a flow diagram of a process for driving a droplet ejection device with multi-pulse waveforms in accordance with one embodiment.

In another embodiment, a printhead includes an ink jet module that includes actuators to eject droplets of a fluid from corresponding pumping chambers and drive electronics that is coupled to the of actuators. During operation the drive electronics drive a first actuator with a first subset of a multi-pulse waveform during a clock cycle to eject a first droplet of a fluid and drive a second actuator with a second subset of the multi-pulse waveform during the clock cycle to eject a second droplet of the fluid. The first subset includes a drive pulse that is positioned in time near a beginning of the clock cycle. The first droplet has a smaller volume than the second droplet. The drive electronics may apply a third subset of the multi-pulse waveform during the clock cycle with the third subset having at least two drive pulses and at least two cancel edges to a third actuator to cause the third actuator to eject a third droplet of the fluid. A first cancel edge is applied subsequent to a first drive pulse of the second subset of the multi-pulse waveform. A second or third cancel edge is applied subsequent to a second drive pulse of the second subset of the multi-pulse waveform. The second subset of the multi-pulse waveform may include four drive pulses and at least two cancel edges. The first droplet of the first subset may have a smaller volume than the third droplet of the third subset FIG. 7 illustrates a flow diagram of a process for driving at least one droplet ejection device with subsets of a multi-pulse waveform in accordance with one embodiment. The multi-pulse waveform includes first, second, and third subsets. Each subset may be applied to a different droplet ejection device during the same clock cycle or these subsets may be applied to the same droplet ejection device during different clock cycles. For example, the first subset can be applied to a droplet ejection device during a first clock cycle, the second subset can be applied to the droplet ejection device during a second clock cycle, and the third subset can be applied to the droplet ejection device during a third clock cycle. In one embodiment, the process for driving the droplet ejection device includes applying a first subset of the multi-pulse waveform to an actuator of the droplet ejection device with the first subset including a drive pulse that is positioned in time near a beginning of a clock cycle of the first subset at processing block 702. The process includes causing the droplet ejection device to eject a first droplet of a fluid in response to the first subset at processing block 704. The process for driving the droplet ejection device includes applying a second subset of the multi-pulse waveform to the actuator at processing block 706. The process includes causing the droplet ejection device to eject a second droplet of the fluid in response to the second subset at processing block 708. In one embodiment, the first subset includes a drive pulse that is positioned in time near or close to a beginning of the clock cycle of the first subset. For example, the drive pulse may be in a first or second predetermined position and a cancellation pulse in a second or third predetermined position. The first droplet has a smaller volume than the second droplet. Smaller droplets travel slower towards the substrate than larger droplets. The first droplet arrives on a first pixel and the second droplet arrives on a second pixel that is adjacent to the first pixel of a substrate because of the early positioning of the drive pulse in the first position of the first subset, which helps to compensate for the slower speed of the first droplet. The second subset of the multi-pulse waveform includes at least two drive pulses and at least two cancel edges (e.g., a first cancel edge and a separate second cancel edge, a first cancellation pulse with first and second cancel edges and a separate third cancel edge). A cancel edge or a cancellation pulse are each designed to not eject a droplet based on being out of phase with respect to previous drive pulses and having a lower maximum voltage amplitude in comparison to drive pulses.

The process may further include applying a third subset of a multi-pulse waveform having at least two drive pulses and at least two cancel edges to the actuator at processing block 710. The process then includes causing the droplet ejection device to eject a third droplet of the fluid at processing block 712.

In one embodiment, the first cancel edge of the third subset is fired subsequent to a first drive pulse of the third subset. A second or third cancel edge is fired subsequent to a fifth drive pulse of the third subset. The third subset of the multi-pulse waveform may include five drive pulses and two or three cancel edges. The droplet ejection device in the method 700 ejects droplets based on the first subset, the second subset, and the third subset of the waveform. The method 700 may also be performed with waveform being applied to each droplet ejection device of a print head. In another embodiment, each subset may be applied to a different droplet ejection device during the same clock cycle.

In an embodiment, a jetting architecture has different waveforms sent to each amplifier in each firing clock cycle. In this example, all start at the beginning of a clock cycle. However, if all waveforms start at the beginning of a fire period of the clock cycle, then small and large size droplets will have consistent arrival times while the middle size droplet will arrive early. The delay of the firing of the middle droplet towards a closing of the firing period will produce a more consistent arrival time for the middle size droplet.

In one embodiment, the droplet ejection device ejects additional droplets of the fluid in response to the pulses of the multi-pulse waveform or in response to pulses of additional multi-pulse waveforms. A waveform may include a series of sections that are concatenated together. Each section may include a certain number of samples that include a fixed time period (e.g., 1 to 3 microseconds) and associated amount of data. The time period of a sample is long enough for control logic of the drive electronics to enable or disable each jet nozzle for the next waveform section. In one embodiment, the waveform data is stored in a table as a series of address, voltage, and flag bit samples and can be accessed with software. A waveform provides the data necessary to produce a single sized droplet and various different sized droplets. For example, a waveform can operate at a frequency of 20 kilo-Hertz (kHz) and produce three different sized droplets by selectively activating different pulses of the waveform. These droplets are ejected at approximately the same target velocity.

Figure 8:
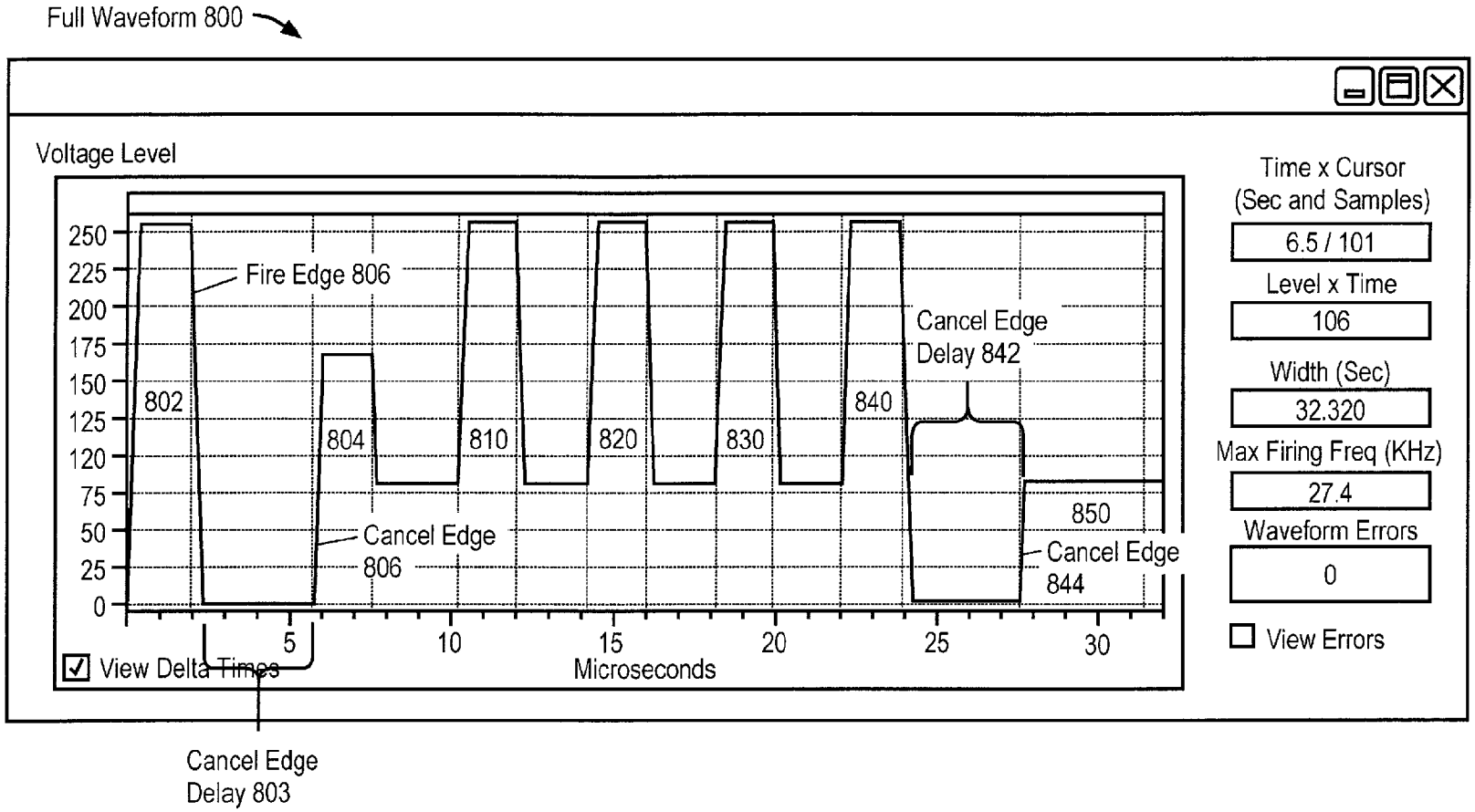
FIG. 8 shows an overall wave train 800 with drive pulses and cancellation pulses in accordance with one embodiment.
Figure 9:
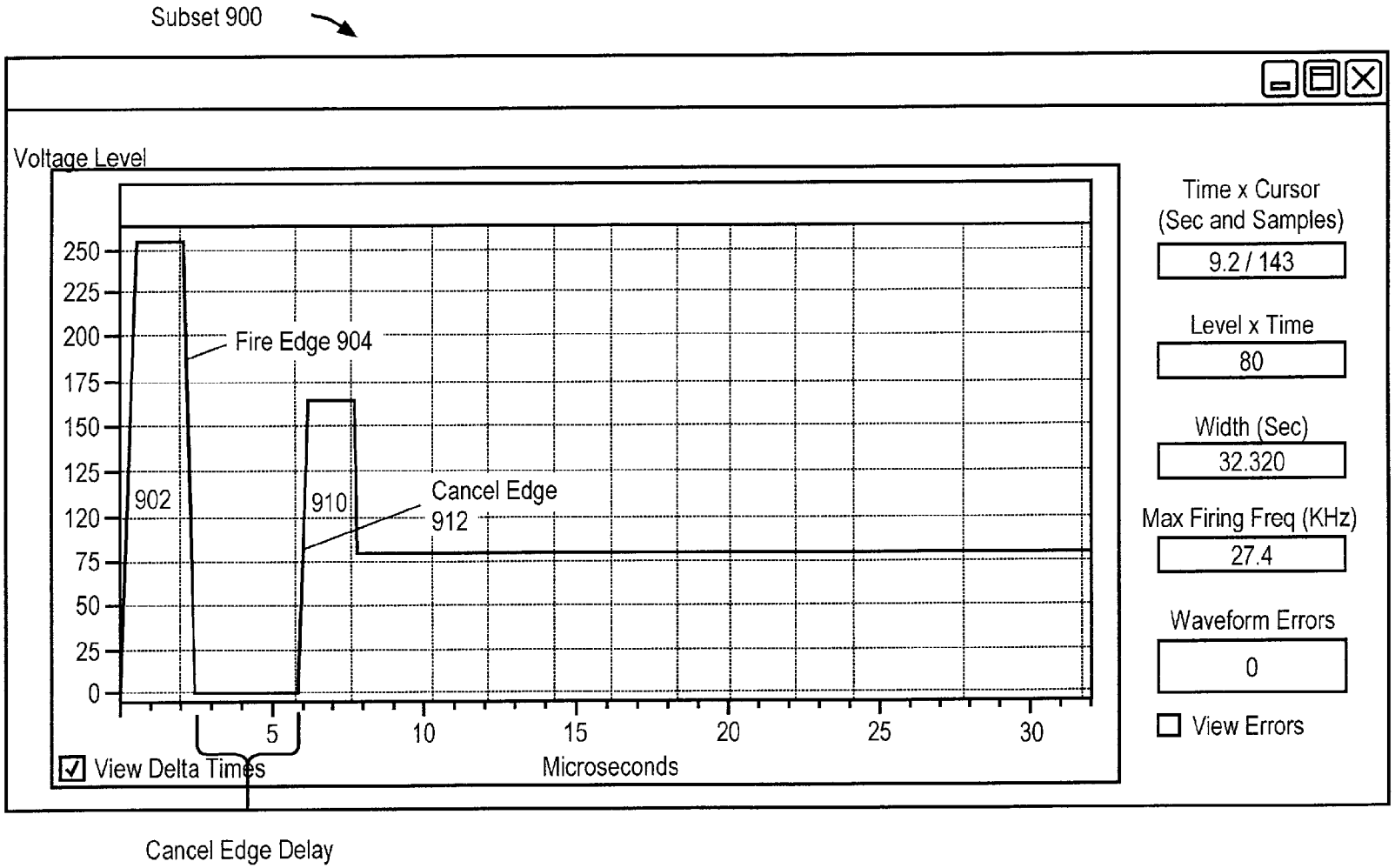
FIG. 9 illustrates a subset 900 of a multi-pulse waveform with a drive pulse and a cancellation pulse in accordance with one embodiment.
Figure 10:
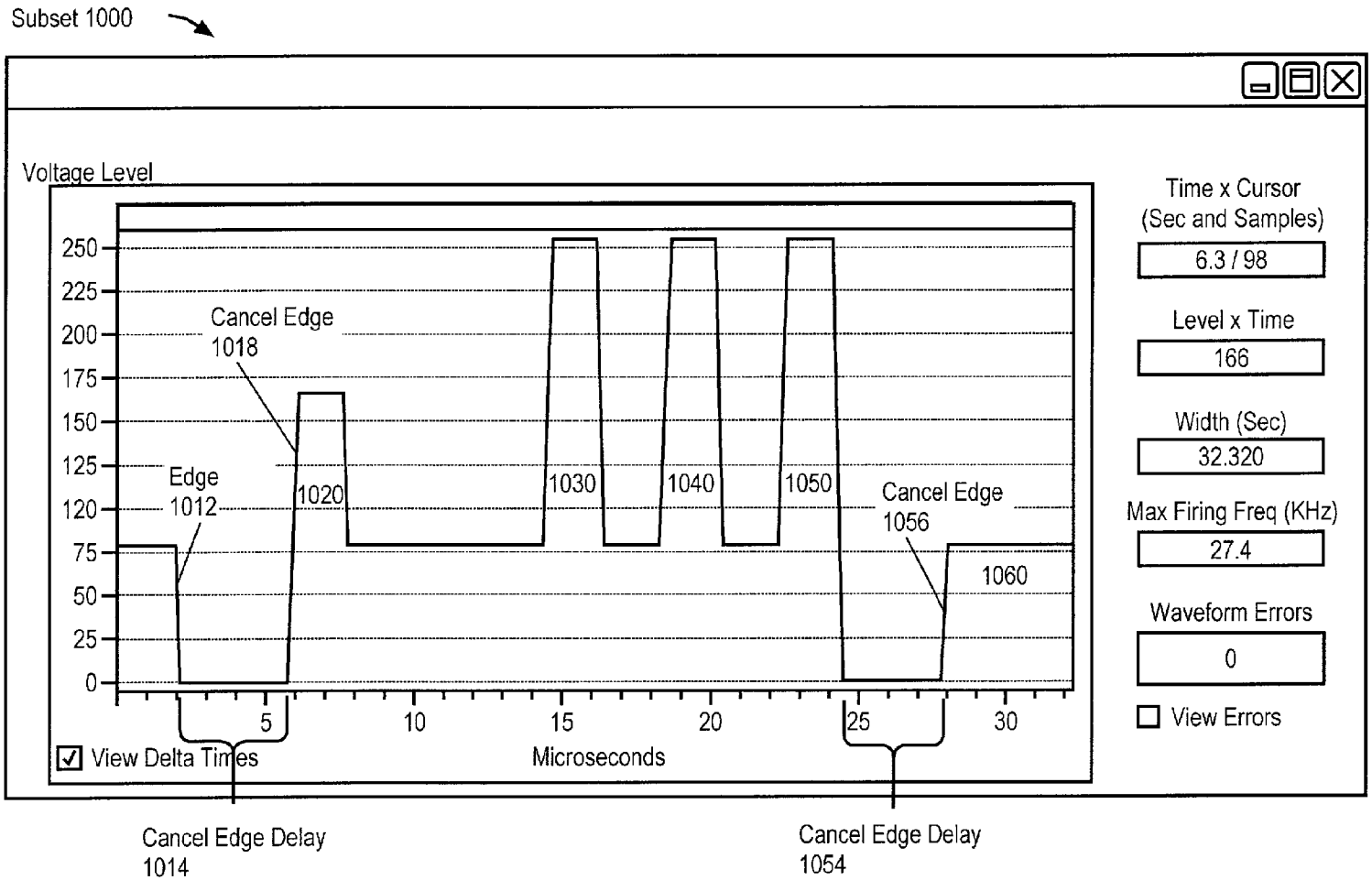
FIG. 10 illustrates a subset 1000 of a multi-pulse waveform with drive pulses and cancel edges in accordance with one embodiment.
Figure 11:
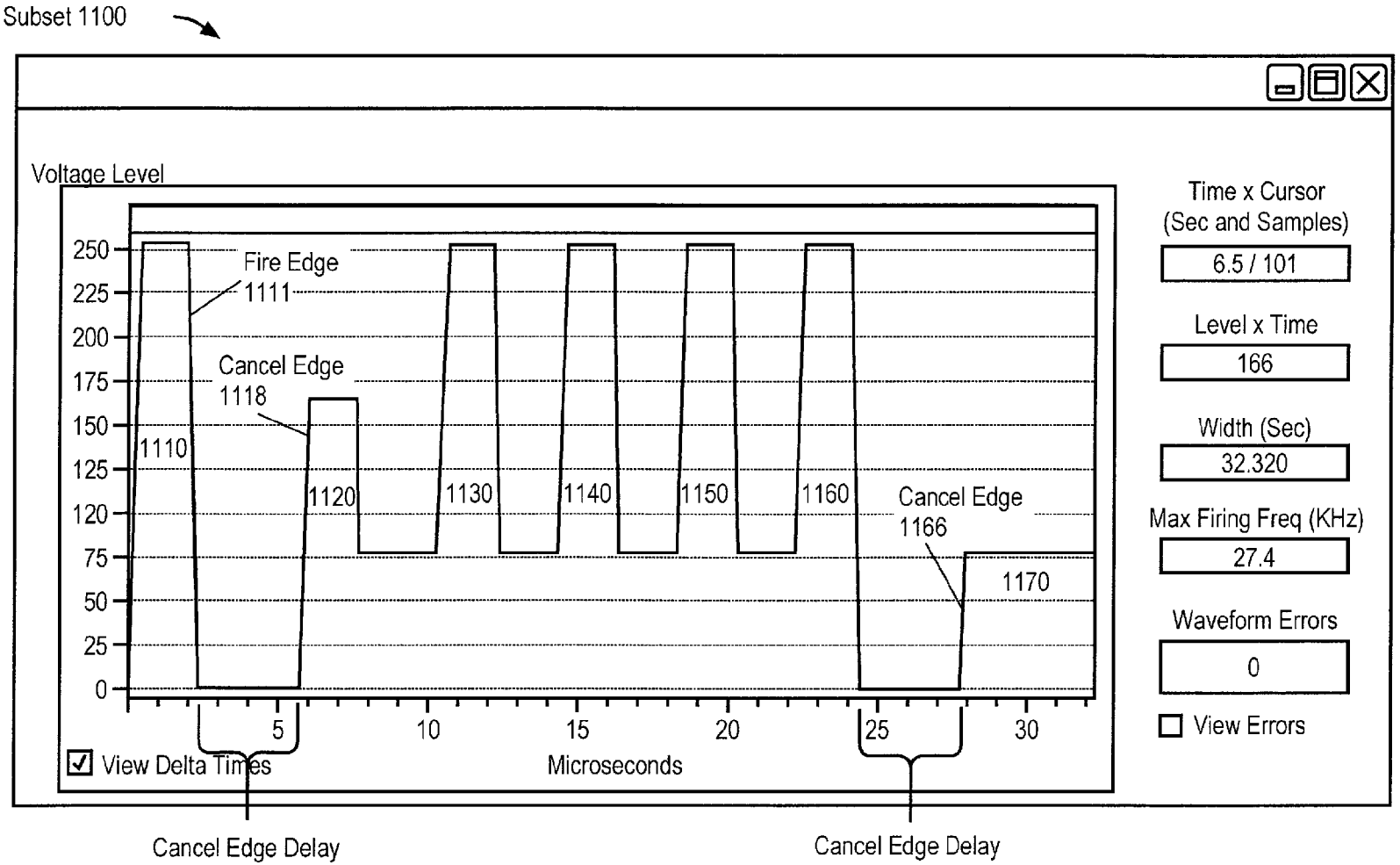
FIG. 11 illustrates a subset 1100 of a multi-pulse waveform with drive pulses and cancel edges in accordance with one embodiment.

FIG. 8 shows an overall wave train 800 with drive pulses and cancel edges in accordance with one embodiment. The wave train 800 includes drive pulses 802, 810, 820, 830, 840, cancellation pulse 804, and cancel edge 844. A cancel edge delay 803 between drive or fire pulse 802 and cancellation pulse 804 is approximately a resonance period Tc such that pressure response wave(s) associated with the cancellation pulse 804 combine destructively with pressure response wave (s) associated with the drive pulse 802. A cancel edge delay 842 between drive or fire pulse 840 and cancel edge 844 is approximately a resonance period Tc. Different portions of the wave train can be applied to an actuator to produce different droplet sizes (e.g., small, medium, large). For example, the pulses 802 and 804 can be applied to produce a small droplet (e.g., 1-3 picoliter (pl) droplet). The drive pulse 802 may be applied to produce a native drop size. The drive pulse 802 may be applied repeatedly in different clock cycles to produce a multiple of a native drop size (e.g., 6 drive pulses produce 6 times the native drop size). The pulses 802, 804, 820, 830, 840, and 850 can be applied to produce a medium droplet (e.g., 4-8 pl droplet). All of the pulses of the wave train 800 may be applied to produce a large droplet (e.g., 9 pl or larger droplet). Other variations of the wave train are also possible. FIGS. 9-11 illustrate different waveforms for producing droplets of different sizes.

FIG. 9 illustrates a subset 900 of a multi-pulse waveform with a drive pulse and a cancellation pulse in accordance with one embodiment. The subset 900 includes predetermined positions in time with a drive pulse 902 having a fire edge 904 in a first predetermined position and a cancellation pulse 910 in a second predetermined position. These pulses can be applied to an actuator to produce a small droplet size. A cancel edge delay 904 between drive or fire pulse 902 and cancellation pulse 910 is approximately a resonance period Tc. The cancellation pulse 910 begins with a cancel edge 912. In the embodiment shown, the amplitude of the cancellation pulse 910 controls the meniscus motion.

FIG. 10 illustrates a subset 1000 of a multi-pulse waveform with drive pulses and cancel edges in accordance with one embodiment. The subset 1000 includes predetermined positions in time with drive pulses 1030, 1040, 1050, cancel pulse 1020, cancel edge 1056, edge 1012 in different predetermined positions (e.g., edge 1012 in a first predetermined position, pulse 1020 in a second predetermined position, etc.). These pulses can be applied to an actuator to produce a medium droplet size. A cancel edge delay 1014 between edge 1012 and cancellation pulse 1020 is approximately a resonance period Tc. The cancellation pulse 1020 begins with a cancel edge 1018. A cancel edge delay 1054 between drive or fire pulse 1050 and cancel edge 1056 is approximately a resonance period Tc. In the embodiment shown, the amplitude of the cancellation pulse 1020 performs two functions. It controls the meniscus motion and can provide mass for subsequent pulses (e.g., pulse 1030).

FIG. 11 illustrates a subset 1100 of a multi-pulse waveform with drive pulses and cancel edges in accordance with one embodiment. The subset 1100 with drive pulses 1110, 1130, 1140, 1150, 1160, cancellation pulse 1120, and cancel edge 1166 can be applied to an actuator to produce a large droplet size. The drive pulse 1110 includes a fire edge 1111 for ejecting a droplet. A cancel edge delay 1112 between drive or fire pulse 1110 and cancellation pulse 1120 is approximately a resonance period Tc. The cancellation pulse 1120 begins with a cancel edge 1118. A cancel edge delay 1164 between drive or fire pulse 1160 and cancel edge 1166 is approximately a resonance period Tc. In the embodiment shown, the amplitude of the cancellation pulse 1120 performs two functions. It controls the meniscus motion and provides mass for subsequent pulse (e.g., 1130) if the amplitude is sufficiently large.

Figure 12A:
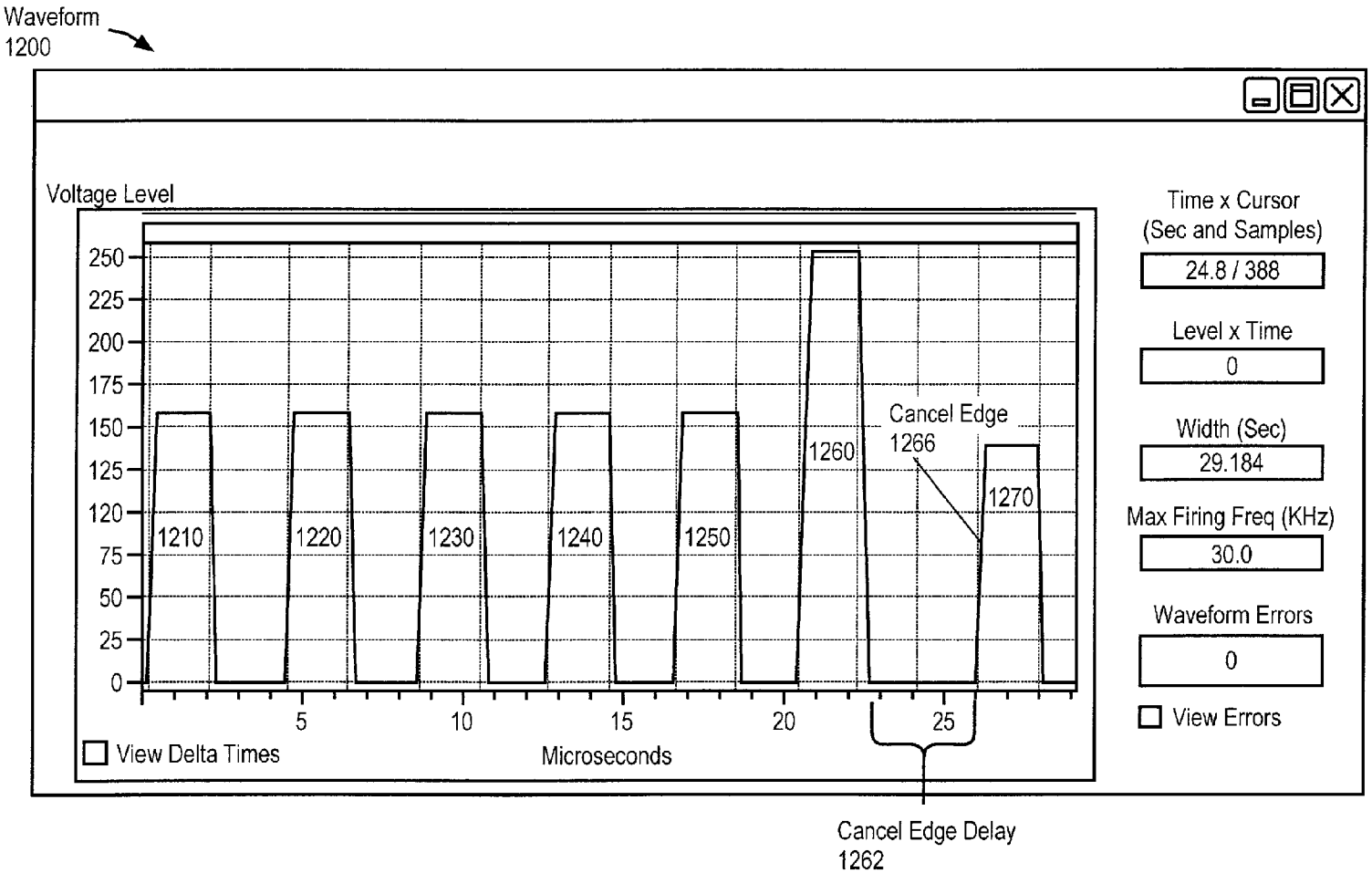
FIG. 12A PRIOR ART
FIG. 12A illustrates a multi-pulse waveform with drive pulses and same sense cancellation pulses in accordance with a prior approach.

FIG. 12A illustrates a multi-pulse waveform 1200 with drive pulses and a same sense cancellation pulse in accordance with a prior approach. The multi-pulse waveform 1200 with drive pulses 1210, 1220, 1230, 1240, 1250, and 1260 and cancellation pulse 1270 can be applied to an actuator to produce a large droplet size. The drive pulse 1260 and cancellation pulse 1270 can be applied to produce a small droplet size. A cancel edge delay 1262 between drive or fire pulse 1260 and cancellation pulse 1270 is approximately a resonance period Tc. The cancellation pulse 1270 begins with a cancel edge 1266.

Figure 12B:
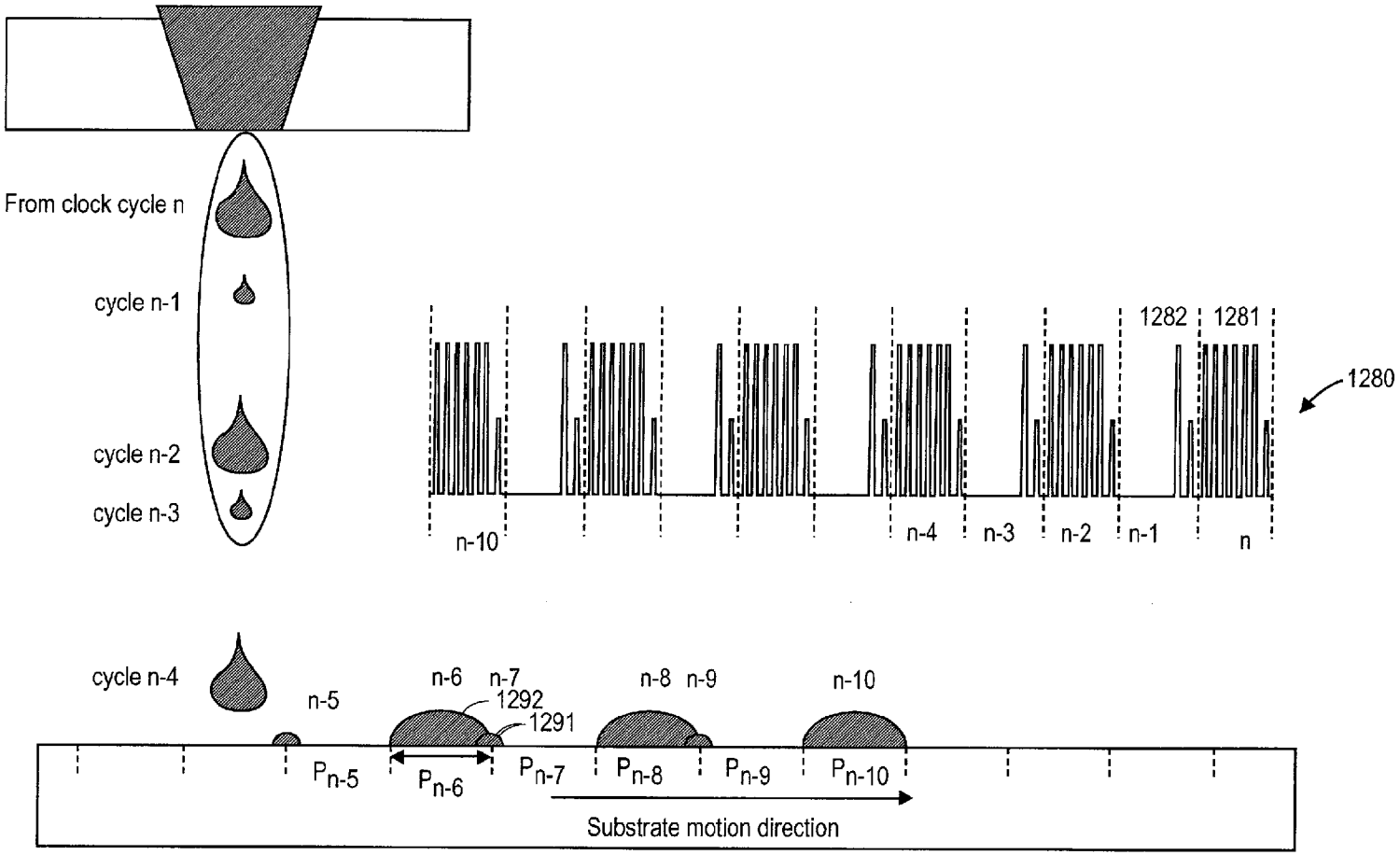
FIG. 12B PRIOR ART
FIG. 12B illustrates the ejection of alternating large and small droplets on a substrate one per clock cycle in accordance with a prior approach.

FIG. 12B illustrates the ejection of alternating large and small droplets on a substrate one per clock cycle in accordance with a prior approach. A large droplet subset 1281 of waveform 1280 during a clock cycle n and a small droplet subset 1282 of waveform 1280 during a clock cycle n-1 are repeatedly applied to an actuator of a droplet ejection device, which ejects large droplets on appropriate intended pixels (e.g., Pn-10, Pn-8, Pn-6) while small droplets straddle pixels rather than arriving within appropriate intended pixels (e.g., Pn-5, Pn-7, Pn-9). The small droplets travel slower than the large droplets, which catch up with a small droplet of a previous clock cycle. For example, the large droplet 1292 in pixel Pn-6 is fired during a n-6 clock cycle and has caught up with the small droplet 1291 that is fired during a n-7 clock cycle and straddles the pixels Pn-6 and Pn-7. The small droplets can easily end up in the same pixel as a subsequent large droplet because the small droplet subsets (e.g., 1282) fire the small droplet with a fire pulse towards the end of the clock cycle. If a sequence of small droplets is followed by a sequence of large droplets in accordance with this prior approach, then the small droplets will straddle pixels because of the late release of the fire pulse within a clock cycle for the small droplet waveform.

FIG. 12B illustrates the impact of disparate droplet arrival caused by disparate droplet release and droplet velocities from a single jet. Naturally, the same impact for the prior approach will happen with neighboring jets with the additional effect of a spatial offset.

Figure 13A:
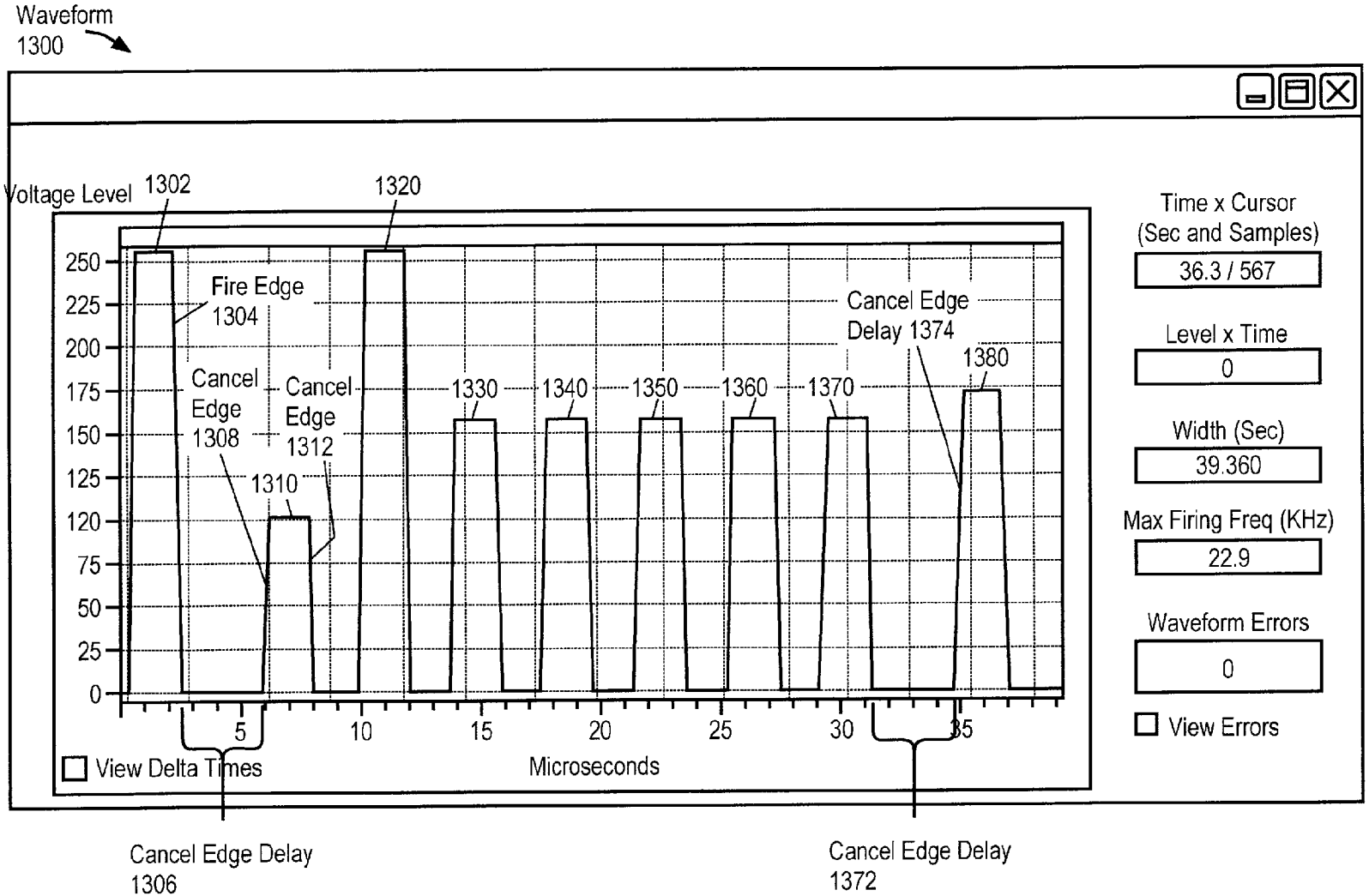
FIG. 13A illustrates a multi-pulse waveform with drive pulses and same sense cancellation pulses in accordance with one embodiment.

FIG. 13A illustrates a multi-pulse waveform 1300 with drive pulses and same sense cancellation pulses in accordance with one embodiment. The multi-pulse waveform 1300 with drive pulses 1302, 1320, 1330, 1340, 1350, 1360, 1370, and cancellation pulses 1310 and 1380 can be applied to an actuator to produce a large droplet size. A cancel edge delay 1306 between drive or fire pulse 1302 and cancellation pulse 1310 is approximately a resonance period Tc. The cancellation pulse 1310 begins with a cancel edge 1308 and ends with a cancel edge 1312. A cancel edge delay 1372 between drive or fire pulse 1370 and cancellation pulse 1380 is approximately a resonance period Tc. The cancellation pulse 1380 begins with a cancel edge 1374. The drive pulse 1302 and cancellation pulse 1310 can be applied to produce a small droplet size.

Figure 13B:
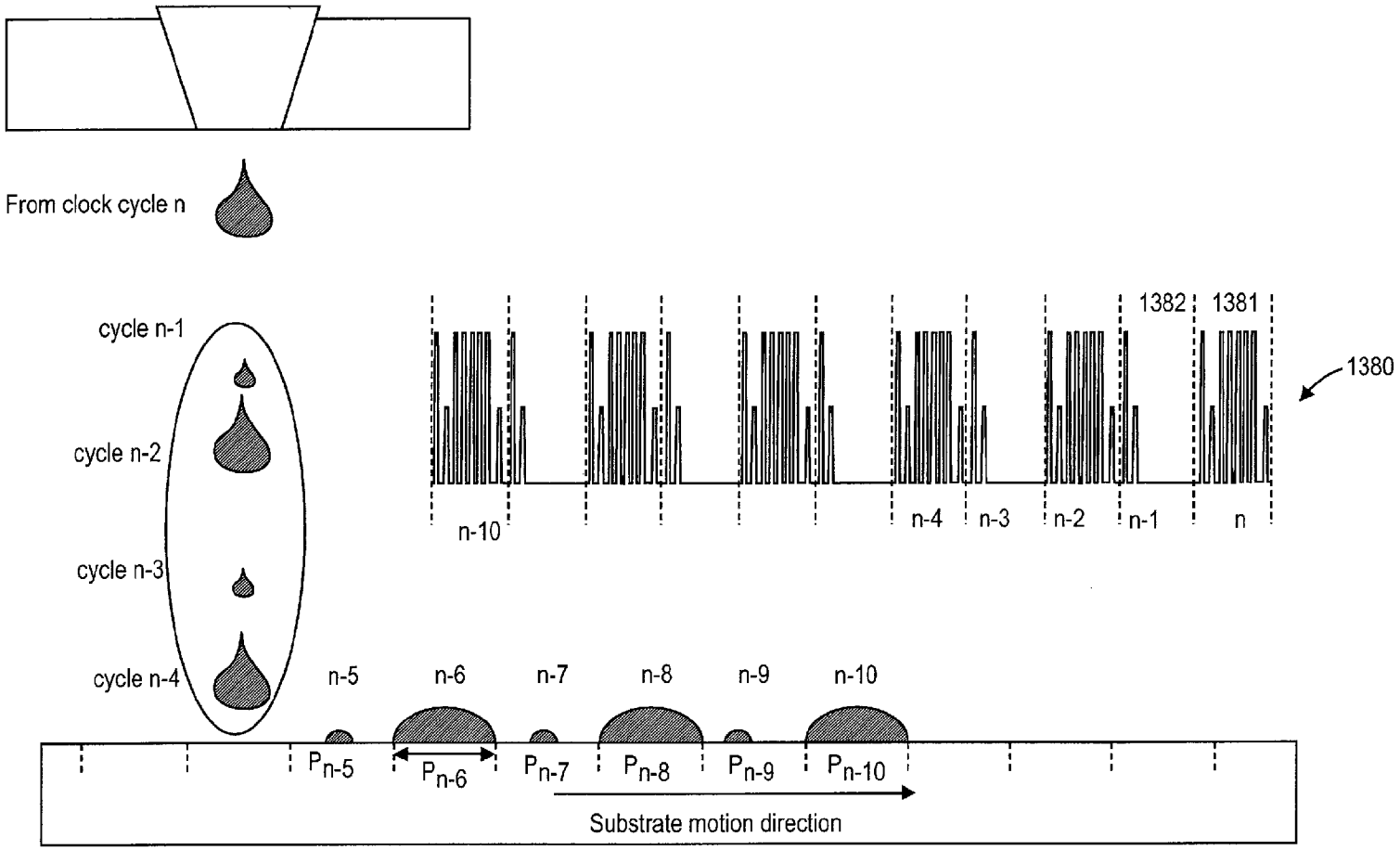
FIG. 13B illustrates the ejection of alternating large and small droplets on a substrate one per clock cycle in accordance with one embodiment.

FIG. 13B illustrates the ejection of alternating large and small droplets on a substrate one per clock cycle in accordance with one embodiment. A large droplet subset 1381 of waveform 1380 during a clock cycle n and a small droplet subset 1382 of waveform 1280 during a clock cycle n-1 are repeatedly applied to an actuator of a droplet ejection device, which ejects large droplets within appropriate intended pixels (e.g., Pn-10, Pn-8, Pn-6) and small droplets within appropriate intended pixels (e.g., Pn-5, Pn-7, Pn-9). The small droplets arrive within appropriate intended pixels of the substrate because the small droplet subsets (e.g., 1382) fire the small droplet with a fire pulse that is positioned in time near the beginning of the clock cycle (e.g., in a first predetermined position in time).

Figure 14:
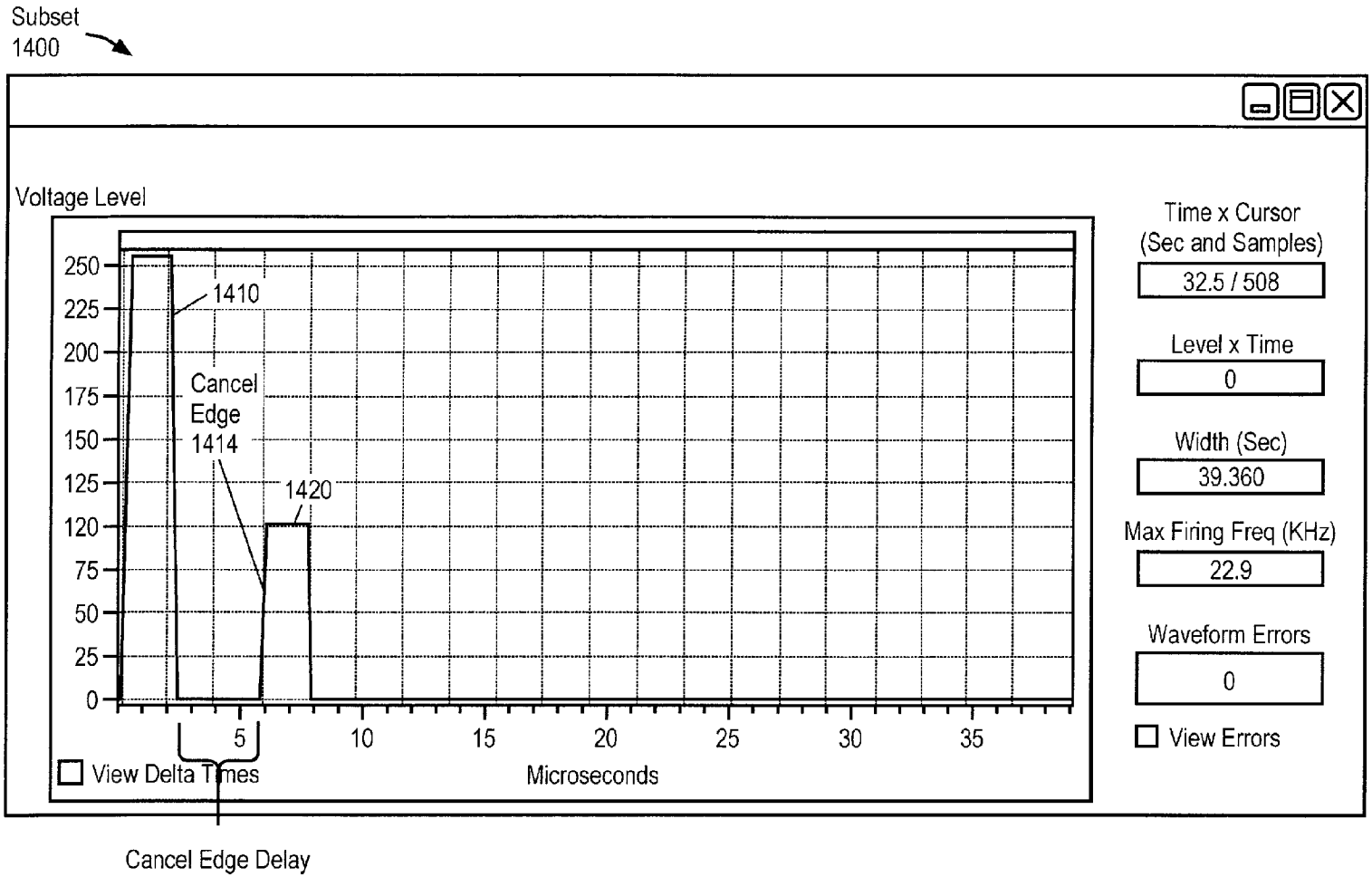
FIG. 14 illustrates a subset 1400 of a multi-pulse waveform with a drive pulse and a same sense cancellation pulse in accordance with one embodiment.

FIG. 14 illustrates a subset 1400 of a multi-pulse waveform with a drive pulse and a same sense cancellation pulse in accordance with one embodiment. A cancel edge delay 1412 between drive or fire pulse 1410 and cancellation pulse 1420 is approximately a resonance period Tc. The cancellation pulse 1420 begins with a cancel edge 1414. The drive pulse 1410 in a first predetermined position in time and the cancellation pulse 1420 in a second predetermined position in time can be applied to produce a small droplet size.

The following table shows a comparison of arrival times for small and large droplets produced with the waveforms of FIGS. 12A and 13A.

| | | Arrival Times (usec) | | | | ArrivalTime Difference |
|---|---|---|---|---|---|---|
| | | @900 um | @1000 um | @1100 um | TrueVel1000 (m/s) | @ 1000 um (usec) |
| FIG. | small | 90 | 101 | 113 | 8.7 | |
| 13 | large | 90 | 98 | 107 | 11.8 | −3 |
| FIG. | small | 112.6 | 124.6 | 135.6 | 8.7 | |
| 12 | large | 89.1 | 97.6 | 106.1 | 11.8 | −27 |

Note that the drop velocities of both small droplets and both large droplets are the same as indicated in the TrueVel1000 (m/s) column. The Arrival Times in microseconds (usec) are given for three different distances (e.g., 900 um, 1000 um, 1100 um) from a nozzle plate to a target medium (e.g., paper). The ArrivalTime Differences column indicates an arrival time difference at a distance of 1000 um for a small droplet and a large droplet generated with the waveforms of FIGS. 12A and 13A. For example, for FIG. 13A, a small droplet has an arrival time of 101 usec while a large droplet has an arrival time of 98 usec. Thus, the ArrivalTime Difference column has a value of −3 usec. In other words, the small droplet arrives on the paper 3 usec later than the large droplet. In contrast, the ArrivalTime Difference column for the prior waveforms of FIG. 12A is −27 usec. Though the droplets of a single type (i.e., waveforms of FIG. 12, waveforms of FIG. 13) have disparate velocities, the arrival time difference between the large and small droplets for waveforms made with the new design of FIG. 13A is small (3 usec) while the arrival time difference for the prior waveforms of FIG. 12A is large (27 usec).

In a specific embodiment, a pixel for the above table is 21 um in length and 21 um in width. Hence, if the substrate or medium (i.e., paper) is moving at 1 m/s, a droplet arriving 27 usec late will land in the next pixel. This arrival time difference can possibly be compensated for with additional design parameters. However, the new waveforms of FIG. 13A don't require that compensation.

It is very common for the large and small droplets to have different velocities because small droplets slow down more due to air resistance. The droplet can be designed to go faster, but above a limit (e.g., around 12 m/s dependent on the exact printhead design) the drop formation gets stringy and poor. The large droplet is designed to have a large mass. If the large droplet is designed at a slower velocity, then the mass is reduced. Hence, it is common that the big droplets go faster. The multi-pulse pulses are designed at-near resonance and hence do not need as much voltage to go faster. By their nature, large droplets tend to have large tails unless they go extremely slow (e.g., less than 7 m/s). Hence, making the large droplets go a bit faster to get more mass does not really make the large droplets particularly worse than the large droplets would be if the large droplets went a bit slower.

Waveforms according to embodiments of the present disclosure have advantages in comparison to prior approaches. A small droplet produced with a fire pulse that is applied towards the beginning of a clock cycle arrives at a substrate in a timely manner at approximately the same time as other droplets (e.g., medium droplet, large droplet) arrive at the substrate. The small droplets land within appropriate intended pixels. The positioning of a cancellation pulse in the interior or middle of the waveform allows the large meniscus motion resulting from the strong first pulse to be removed or at least reduced, which allows the following pulses to deliver more mass. As can be seen in FIGS. 1*a*, 1*b*, 2*a*, and 2*b*, waveforms of prior approaches have decreasing amplitude between the 1$^{st}$ pulse and the small drop pulse (e.g., pulse 197 of FIG. 1*b*). This amplitude decrease is needed because as the number of pulses increases, the residual energy from the previous pulses tends to overdrive the meniscus resulting in poor drop formation, which is addressed by reducing the amplitude of subsequent pulses. However, the reduction in amplitude leads to a reduction in mass which in turn requires additional pulses and so on. In this way, the pulse train tends to get very large if large droplets are desired for this prior approach.

In contrast with prior approaches, embodiments of the present invention permit the first cancellation pulse to stop the meniscus after the first firing pulse. The meniscus motion is relatively less for the large droplet for waveforms as described herein. Hence, the amplitudes can be bigger and fewer pulses are needed. In embodiments disclosed and illustrated herein, the number of pulses needed is sufficiently low to allow each to have approximately the same amplitude and contribute approximately the same amount of mass as the single droplet. For waveforms according to the present design, the additional mass per pulse can be very close to a multiple of a mass of a native droplet. As an example, using the waveforms shown in FIGS. 9 and 11 with a small droplet mass of 2 picoliters (pl), the large drop volume is just over 11.4 pL yielding a volume per drop of approximately 90-95% of the small droplet volume. By contrast, waveforms like those shown in FIGS. 1*a*, 1*b*, 2*a*, and 2*b* often yield less than 80% of the small droplet when attempting to achieve large droplets.

The waveforms of the present disclosure can be used for a wide range of operating frequencies to advantageously provide different droplets sizes that arrive at approximately the same time on a substrate. This permits improved drop formation for each drop size, enables improved control over the drop velocities and droplet arrival times (i.e., improved placement control), reduces and/or eliminates a meniscus bounce, and enables ink jet operation over a wide range of frequencies.

Figure 15:
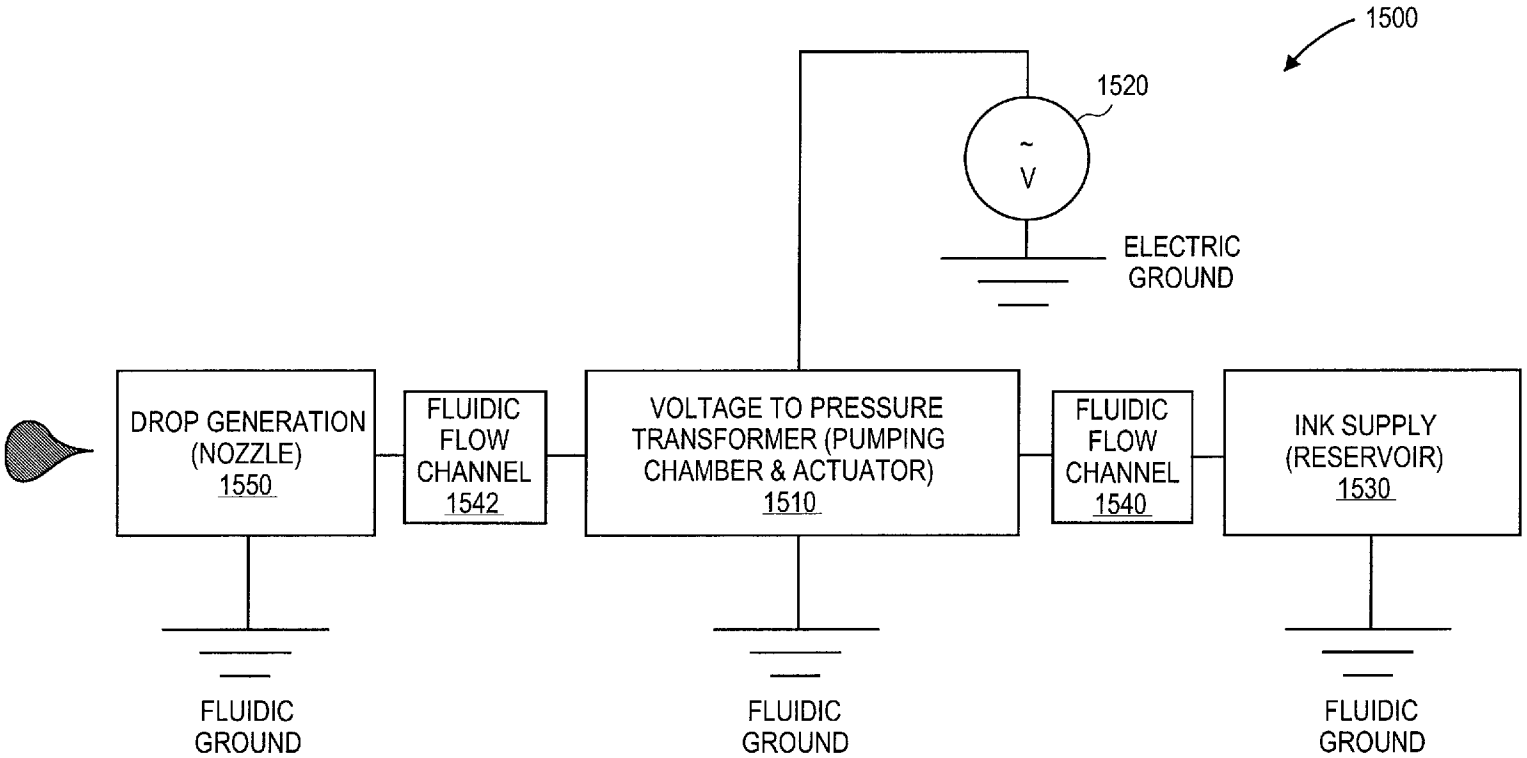
FIG. 15 illustrates a block diagram of an ink jet system in accordance with one embodiment.

FIG. 15 illustrates a block diagram of an ink jet system in accordance with one embodiment. The ink jet system 1500 includes a voltage source 1520 that is applied to a voltage to pressure transformer 1510 (e.g., pumping chamber and actuator), which may be a piezoelectric or heat transformer. An ink supply 1530 supply ink to a fluidic flow channel 1540, which supplies ink to the transformer. The transformer provides the ink to a fluidic flow channel 1542. This fluidic flow channel allows pressure from the transformer to propagate to a drop generation device 1550 having orifices or nozzles and generate one or more droplets if one or more pressure pulses are sufficiently large. Ink level in the ink jet system 1500 is maintained through a fluidic connection to the ink supply 1530. The drop generation device 1550, transformer 1540, and ink supply 1530 are coupled to fluidic ground while the voltage supply is coupled to electric ground.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method of ejecting droplets of a fluid from a droplet ejection device, comprising:

applying a first subset of a multi-pulse waveform to an actuator of the droplet ejection device;

causing the droplet ejection device to eject a first droplet of the fluid in response to the first subset;

applying a second subset of the multi-pulse waveform to the actuator; and causing the droplet ejection device to eject a second droplet of the fluid in response to the second subset, wherein the first subset precedes the second subset in the multi-pulse waveform, wherein the first droplet has a smaller volume than the second droplet, wherein the first subset includes a drive pulse that precedes a cancel pulse in the first subset of the multi-pulse waveform.

2. The method of claim 1, wherein the first droplet arrives on a first pixel and the second droplet arrives on a second pixel that is adjacent to the first pixel of a substrate.

3. The method of claim 1, further comprising:

applying a third subset of the multi-pulse waveform to the actuator; and causing the droplet ejection device to eject a third droplet of the fluid in response to the third subset of the multi-pulse waveform.

4. The method of claim 3, wherein the third subset of the multi-pulse waveform includes at least two drive pulses and at least two cancel edges, wherein the first droplet that is caused by applying the first subset has a smaller volume than the third droplet.

5. The method of claim 4, wherein a first cancel edge is applied subsequent to a first drive pulse of the third subset, wherein a second cancel edge is applied subsequent to a second drive pulse of the third subset of the multi-pulse waveform.

6. The method of claim 4, wherein the third subset of the multi-pulse waveform comprises five drive pulses and three cancel edges.

7. The method of claim 1, wherein the second subset of the multi-pulse waveform comprises four drive pulses and three cancel edges.

8. A method of ejecting droplets of a fluid from a droplet ejection device, comprising:

applying a first subset of a multi-pulse waveform to an actuator of the droplet ejection device;

causing the droplet ejection device to eject a first droplet of the fluid in response to the first subset;

applying a second subset of the multi-pulse waveform to the actuator; and causing the droplet ejection device to eject a second droplet of the fluid in response to the second subset, wherein the first subset precedes the second subset in the multi-pulse waveform, wherein the first droplet has a smaller volume than the second droplet, wherein a first cancel edge is applied subsequent to a first drive pulse of the second subset of the multi-pulse waveform.

9. The method of claim 8, wherein a second cancel edge is applied subsequent to a second drive pulse of the second subset of the multi-pulse waveform.

10. An apparatus for ejecting droplets of a fluid, comprising:

an actuator to eject droplets of the fluid from a pumping chamber; and drive electronics coupled to the actuator, wherein during operation the drive electronics to drive the actuator with a first subset of a multi-pulse waveform to eject a first droplet of a fluid and to drive the actuator with a second subset of the multi-pulse waveform to eject a second droplet of the fluid, wherein the first subset precedes the second subset in the multi-pulse waveform, wherein the first droplet has a smaller volume than the second droplet, wherein a first cancel edge is applied subsequent to a first drive pulse of the second subset of the multi-pulse waveform.

11. The apparatus of claim 10, wherein the first droplet arrives on a first pixel and the second droplet arrives on a second pixel that is adjacent to the first pixel of a substrate.

12. The apparatus of claim 10, wherein a second or third cancel edge is applied subsequent to a second drive pulse of the second subset of the multi-pulse waveform, wherein the second subset of the multi-pulse waveform comprises four drive pulses and at least two cancel edges.

13. The apparatus of claim 12, wherein the drive electronics to apply a third subset of the multi-pulse waveform having at least two drive pulses and at least two cancel edges to the actuator, to cause the droplet ejection device to eject a third droplet of the fluid.

14. A printhead, comprising:

an ink jet module that comprises, a plurality of actuators to eject droplets of a fluid from a corresponding plurality of pumping chambers; and drive electronics coupled to the plurality of actuators, wherein during operation the drive electronics drive a first actuator with a first subset of a multi-pulse waveform during a clock cycle to eject a first droplet of a fluid and to drive a second actuator with a second subset of the multi-pulse waveform during the clock cycle to eject a second droplet of the fluid, wherein the first subset includes a drive pulse that is positioned in a first or a second predetermined position of the first subset, wherein the first droplet has a smaller volume than the second droplet.

15. The printhead of claim 14, wherein the drive electronics to apply a third subset of the multi-pulse waveform during the clock cycle with the third subset having at least two drive pulses and at least two cancel edges to a third actuator to cause the third actuator to eject a third droplet of the fluid.

16. The printhead of claim 15, wherein a first cancel edge is applied subsequent to a first drive pulse of the second subset of the multi-pulse waveform.

17. The printhead of claim 16, wherein a second or third cancel edge is applied subsequent to a second drive pulse of the second subset of the multi-pulse waveform, wherein the second subset of the multi-pulse waveform comprises four drive pulses and at least two cancel edges.

18. The printhead of claim 15, wherein the first droplet has a smaller volume than the third droplet.

* * * * *